United States Patent [19]

Hansen et al.

[11] Patent Number: 4,895,332

[45] Date of Patent: Jan. 23, 1990

[54] ANTI-SLIP GRAB RAIL

[75] Inventors: Randall C. Hansen, Lake Forest, Ill.; Gilbert H. Krahn, Kenosha, Wis.

[73] Assignee: A. L. Hansen Manufacturing Company, Waukegan, Ill.

[21] Appl. No.: 240,942

[22] Filed: Sep. 6, 1988

[51] Int. Cl.[4] ..... A47H 1/14

[52] U.S. Cl. ..... 248/251; 256/59

[58] Field of Search ..... 248/251, 345.1, 65, 248/201, 214, 220.2, 221.3, 223.4, 224.4, 225.1; 4/576; D6/549; 211/105.1, 123; 256/59, 65; 52/34, 102, 730, 731, 732

[56] References Cited

U.S. PATENT DOCUMENTS

| | | | |
|---|---|---|---|
| Re. 21,143 | 7/1939 | Davis | 211/105.1 |
| 1,769,326 | 7/1930 | Weis | D6/549 |
| 2,490,854 | 12/1949 | Bozoti | 248/251 |
| 2,512,203 | 6/1950 | Fluharty | 248/251 |
| 2,644,954 | 7/1953 | Jumper | 4/576 |
| 2,956,767 | 10/1960 | Unetic | 248/251 |
| 3,071,350 | 1/1963 | Opie . | |
| 3,370,389 | 2/1968 | MacAluso | 52/730 |
| 3,784,023 | 1/1974 | Varon | 211/123 |
| 3,842,564 | 10/1974 | Brown | 256/65 |
| 4,002,322 | 1/1977 | Matsubara . | |
| 4,142,343 | 3/1979 | Trafton . | |
| 4,194,338 | 3/1980 | Trafton . | |
| 4,200,261 | 4/1980 | Bartlett | 256/59 |
| 4,353,529 | 10/1982 | Brown | 256/59 |
| 4,523,734 | 6/1985 | Grohe | 248/251 |

OTHER PUBLICATIONS

Gebr. Happich GmbH, "Plastic Sections", Catalog, Jun. 1983.

*Primary Examiner*—Ramon O. Ramirez
*Assistant Examiner*—Robert A. Olson
*Attorney, Agent, or Firm*—Willian Brinks Olds Hofer Gilson & Lione

[57] ABSTRACT

An anti-slip grab rail and grab rail assembly, the grab rail providing improved gripping surfaces which, in the preferred embodiments, are formed by a plurality of exposed surfaces of a rigid elongate bar alternating with a plurality of elastomeric members extending longitudinally of the bar. The elastomeric members preferably take the form of inserts secured within cavities that extend longitudinally of the bar at the surface of the bar. The inserts may be secured within the cavities by aligning the inserts adjacent to the cavities and pushing them transversely into the cavities such that the inserts snap into place and are retained by an interference fit with a portion of a structure of the rail. Improved handling, shipping and strength characteristics are attained by manufacturing and shipping the grab rails in comparatively short lengths of four feet or less and by providing key and key-receiving openings in the grab rail and mounting hardware therefor, preferably at both ends of the grab rail, so as to prevent a grab rail from rotating about a longitudinal axis thereof.

29 Claims, 3 Drawing Sheets

FIG. 1
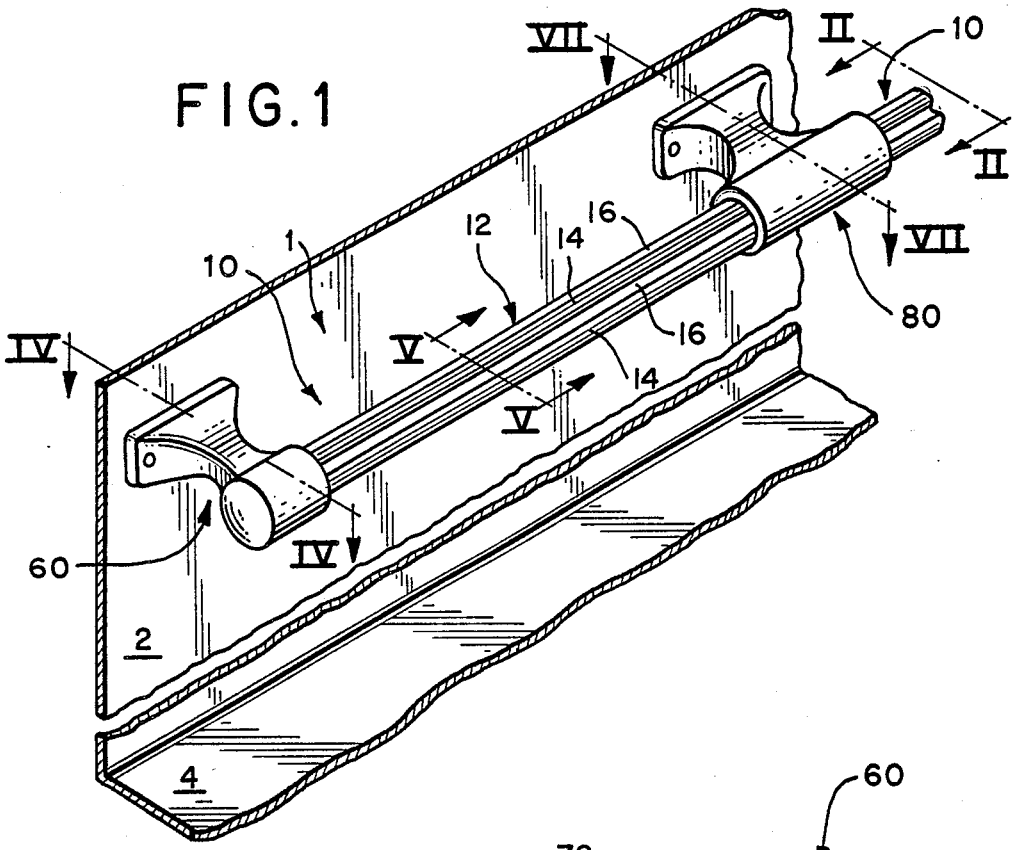
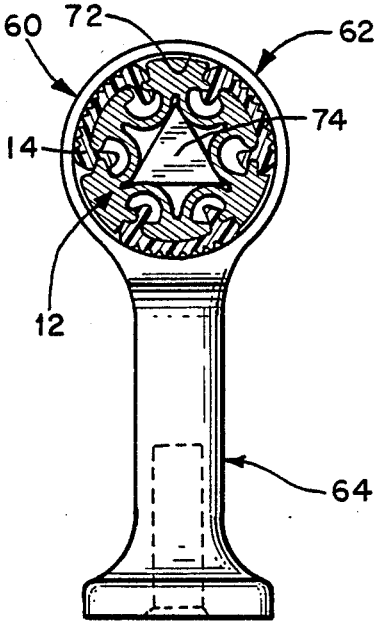
FIG. 5
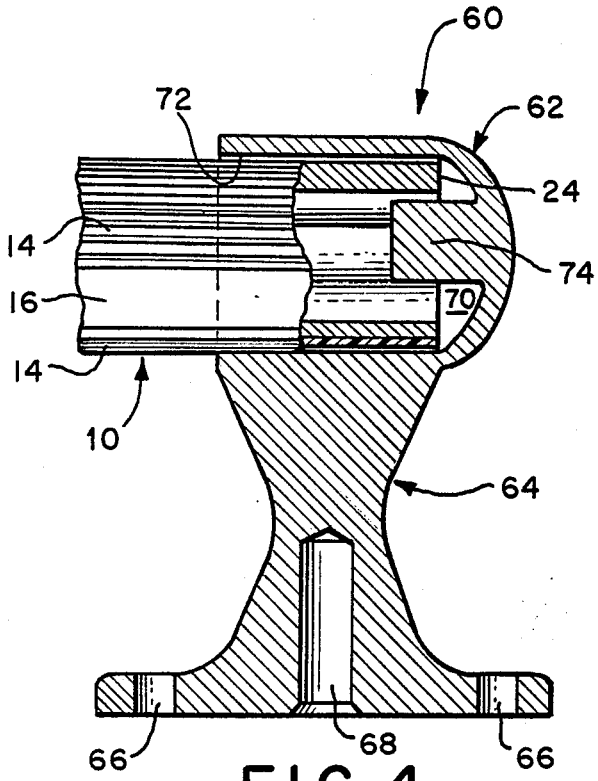
FIG. 4

ANTI-SLIP GRAB RAIL

FIELD OF THE INVENTION

The current invention pertains to grab rails and, in particular, to anti-slip grab rails.

DISCUSSION OF THE BACKGROUND

Hand rails and grab rails supported by stanchions, brackets and the like are known. Typically. they comprise an elongate bar of a single material and often have smooth outer hand-engaging surfaces.

For certain specialized or critical applications such as fire engines and the like, it is important for proper functioning and safety that the grab rail assembly, including a grab rail and the mounting hardware therefor, be as strong as practical in resisting both pulling and torsional forces, and that the grab rail not slip within the mounting hardware in response to torsional forces. Furthermore, it is desirable for the outer surface of a grab rail to be effective as a gripping surface and not promote relative slipping between the material of the grab rail and the hand of a user.

SUMMARY OF THE INVENTION

The current invention provides an anti-slip grab rail suitable for use where high performance is critical, as on fire engines and the like. A presently preferred form of grab rail comprises a rigid elongate bar having formed therein at least two outer cavities opening transversely outwardly of the bar, and at least one, preferably two, elastomeric inserts respectively disposed in the outer cavities and extending transversely outwardly at least to a location proximate an exposed surface of the bar, the inserts and exposed surface of the bar collectively forming gripping surfaces disposed so as to be contacted by the hand of a user who has gripped the grab rail.

Novel mounting hardware cooperates with one or more of the grab rails to form a grab rail assembly. In a presently preferred grab rail assembly, the mounting hardware comprises at least one mount for receiving an end of a grab rail as described above and for fixing the grab rail at a desired location, the grab rail and mount collectively comprising at least one key for reception in at least one key-receiving opening for preventing the grab rail from rotating about a longitudinal axis thereof.

The invention also includes a method of providing an anti-slip grab rail. The presently preferred method comprises the steps of providing a rigid elongate bar having at least one elongate cavity formed therein and opening transversely outwardly of the bar, providing at least one elongate elastomeric member, aligning the elastomeric member adjacent the cavity, and pushing the elastomeric member into the cavity.

BRIEF DESCRIPTION OF THE DRAWINGS

A more complete description of the invention may be obtained with reference to the following drawings, in which like elements are identified by like reference numerals throughout and in which:

FIG. 1 is a perspective view of a grab rail assembly mounted on a vertical wall at a desired location with respect to a walking or standing surface;

FIG. 4, is a transverse cross-section taken on line IV—IV of FIG. 1, of a preferred form of an end mount of mounting hardware for a grab rail according to the current invention, the end mount being in the form of an end stanchion;

FIGS. 5 and 6 are longitudinal views, partly in section taken on line V—V of FIG. 1, the figures respectively illustrating two different rotational dispositions of inserts;

DESCRIPTION OF THE PREFERRED EMBODIMENTS

Figure 2:
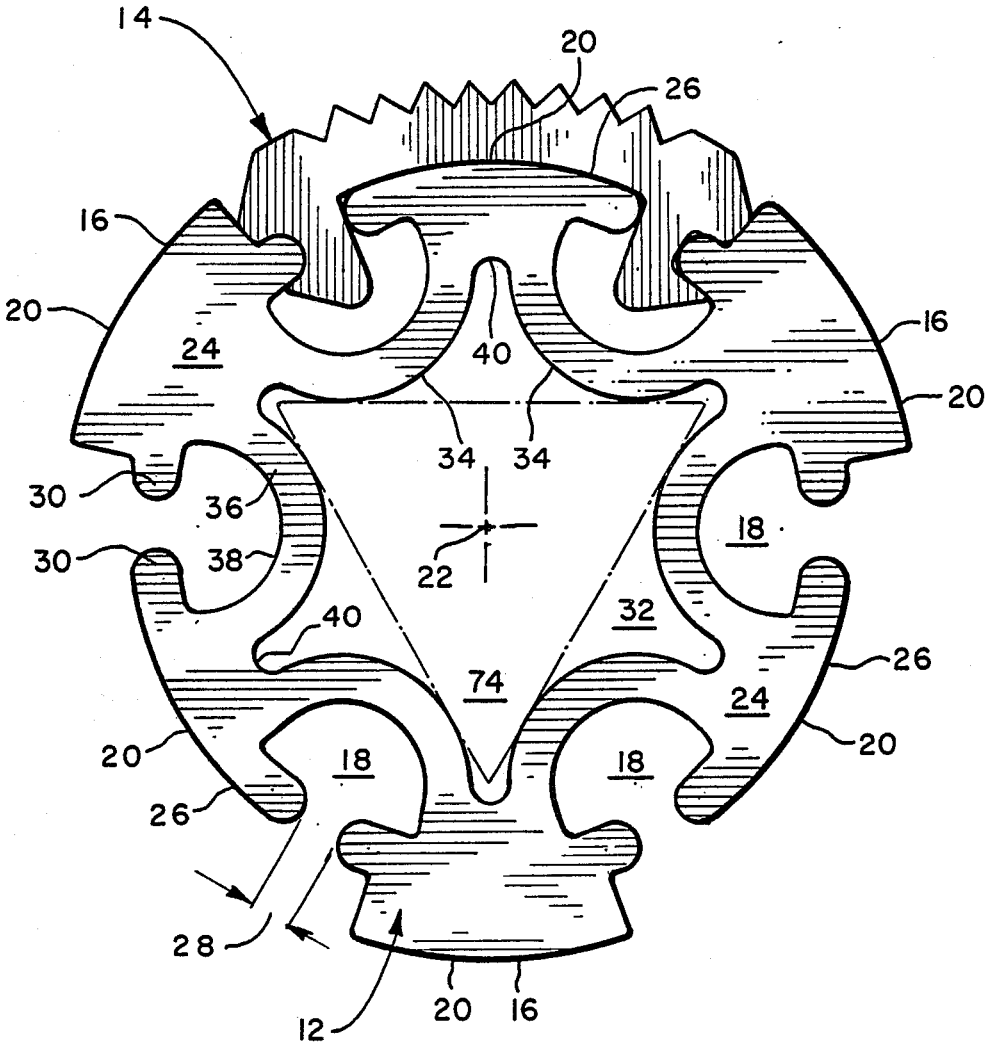
FIG. 2 is an end view of a first and preferred embodiment of a grab rail according to the current invention, taken for example on line II—II of FIG. 1, the embodiment having elastomeric members in the form of inserts only one of which is shown for the sake of clarity, and with a representative in-service position of a typical key of mounting hardware being shown in phantom.

FIG. 1 shows a grab rail assembly 1 fixed on a vertical wall 2 in a desired location, for example at a predetermined distance above a walking or standing surface 4. Although the grab rail assembly 1 is shown fixed on a vertical wall 2, the wall 2 may have any orientation. Likewise, although the grab rail assembly 1 is shown mounted in a horizontal orientation, the assembly 1 may be mounted in a vertical or any other appropriate orientation.

Grab rail assembly 1 comprises one or more grab rails 10 (two such rails being shown in FIG. 1) and mounting hardware for fixing the grab rail or rails 10 at a desired location.

A grab rail 10 according to the current invention comprises a rigid elongate bar 12 and one or more elastomeric members 14. Preferably, at least two elastomeric members 14 are provided.

The elastomeric member or members 14 are disposed proximate an exposed surface 16 of the bar 12 such that the at least one elastomeric member 14 and at least one exposed surface 16 of the bar collectively form gripping surfaces disposed so as to be contacted by the hand of a user who has gripped the grab rail 10. Preferably, the elastomeric members 14 are oriented longitudinally of the bar 12. Also preferably, at least two elastomeric members 14 are provided and are disposed at such positions with respect to the perimeter of the grab rail 10 that the two elastomeric members 14 will be simultaneously contacted by the fingers of a user. Under such circumstances, if the fingers of a user slip off one elastomeric member, another will be present to provide slip resistance. Those of ordinary skill in the art will know how to select such an orientation by examining the geometry of the particular installation involved, for example by referring to the disposition and the location of wall 2 and of the anticipated disposition of the grab rail assembly 1 as a whole with respect to the walking or standing surface 4.

More preferably, three or more elastomeric members 14 are disposed substantially uniformly perimetrically of the rod 12. Such uniform disposition can have certain advantages as will be explained below. However, such uniform disposition is not necessary.

A grab rail assembly 1 according to the current invention also comprises mounting hardware for fixing one or more grab rails at desired locations. Typically, a grab rail assembly 1 according to the current invention will include some form of end mount disposed at a first end of the grab rail assembly 1 and receiving an end of a grab rail 10, and a second end mount disposed at a second end of the grab rail assembly 1, receiving an end of a grab rail 10. A preferred form of an end mount according to the current invention is shown in FIG. 1 as end stanchion 60. Other forms of mounting hardware besides stanchions may be used depending upon the geometry of the installation and desires of the installer. For example, if one were to affix a grab rail assembly 1 between two substantially opposed and parallel walls, one may prefer to use an end mount more closely resembling a plate rather than an end mount of the stanchion type.

The ends of two adjacent rails 10 may be received in an inner mount such as an inner stanchion 80.

The mounting hardware such as the stanchions 60,80 preferably receive the opposite ends of the grab rails 10, including the ends of elastomeric members 14.

A first and preferred embodiment of a grab rail 10 will now be discussed with reference to FIGS. 2 and 3. FIG. 2 is an end view of a grab rail 10 according to the first embodiment, taken along the line II—II of FIG. 1. An even number of outer cavities 18 are formed in bar 12 and open transversely outwardly of the bar. Preferably, pairs of the cavities 18 are disposed at equal angular intervals around the bar 12. Elastomeric members 14 in the form of inserts are disposed in the cavities 18, the number of inserts being equal to one-half of the number of cavities 18. For clarity, only one insert 14 is illustrated in FIG. 2. It will be understood that two additional inserts are disposed in the remaining cavities at equal angular intervals perimetrically of the bar 12.

Outer surfaces 20 of bar 12 are disposed at different distances from a longitudinal axis 22. In particular, exposed surfaces 16 are disposed a greater distance from longitudinal axis 22, and support surfaces 26 (so-called because they underlie and support the inserts 14) are disposed a lesser distance from the longitudinal axis 22. In this embodiment the exposed surfaces and support surfaces are disposed on concentric circles.

Preferably, the inserts 14 extend transversely outwardly of the cavities 18 at least to a location proximate the exposed surfaces 16 and more preferably as shown in FIG. 2 to a location transversely beyond the exposed surfaces 16.

Preferably, the outer cavities 18 extend longitudinally of the bar 12 for substantially the entire length of the bar 12, and most preferably throughout the entire length of the bar 12, opening into opposite end faces 24 thereof. Preferably, each insert 14 also extends longitudinally of the bar for substantially the entire length of the bar, and most preferably for the entire length of the bar.

Each of the outer cavities 18 has a constricted opening 28 formed by opposed protrusions 30. In this manner, a distance across the constricted opening 28, taken generally perimetrically of the bar, is less than a distance across the associated outer cavity 18, taken in substantially the same direction and at a location transversely inwardly of the constricted opening 28.

If desired, the bar 12 may have a solid interior. However, it is preferred for an inner cavity 32 to be formed in the bar 12 and extend longitudinally therein from at least one end face 24 of the bar. More preferably, an inner cavity 32 opens into both end faces 24 of the bar 12, and most preferably a single inner cavity 32 extends along the entire length of the bar 12.

The shape of inner cavity 32 in transverse cross-section is governed by the configuration of interior side walls 34. A number of such configurations are possible according to which the inner cavity 32 functions as a key-receiving opening for cooperation with a key 74 (shown in phantom) of the mounting hardware. as described more fully below. In the illustrated and preferred configuration, arcuate partitions 36 form curved bottom surfaces 38 of the outer cavities 18 and the curved interior side walls 34, the latter meeting in a plurality of points 40 which may be blunt, as shown.

Figure 3:
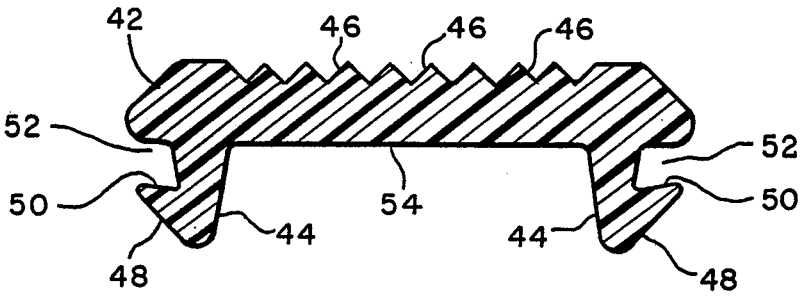
FIG. 3 is a transverse cross-section of an insert of the type, shown in FIG. 2.

FIG. 3 shows in more detail an insert 14 of the type shown in FIG. 2. Insert 14 comprises a main portion 42 having two legs 44 depending therefrom. Preferably, the transversely outermost surface of insert 14 is textured to improve slip resistance. In the illustrated embodiment, the textured surface is formed by a plurality of ribs formed by flat surfaces 46 that meet at right angles.

A camming face 48 is formed on the distal portion of at least one, and preferably each leg 44 as shown. Each camming face 48 tapers transversely outwardly to a restraining surface 50 of an inset 52.

An important advantage of a grab rail according to the first embodiment may be seen by considering the nature of the cooperation between the insert 14 and bar 12. In order to assemble a grab rail 10 an insert 14 may be aligned longitudinally of the bar 12, the legs 44 of the insert pointing toward adjacent outer cavities 18. The insert 14 is then disposed within the two outer cavities 18 by pushing the insert into the cavities. Camming faces 48 operate to deform portions of the legs 44 until one of the protrusions 30 is received in each inset 52. At such time, the protrusions 30 interfere with the restraining surfaces 50, thereby substantially securing the insert from exiting the outer cavities in a transverse direction.

At such time a transversely inner surface 54 of the insert, which preferably is a substantially smooth and continuous surface is supported by support surface 26 of the bar 12. Support surface 26 also is preferably substantially smooth and continuous over its entire extent between adjacent cavities 18. The continuous support provided by the support surface 26 is thought to improve the contribution of the insert 14 to the anti-slip properties of the grab rail.

In each of the outer cavities 18, the protrusion 30 that is not received in the inset 52 serves the function of extending perimetrically the extent of the support surface 26 and further is available if needed for contacting an opposed face of a leg 44 to help minimize slipping of an insert 14 during use and to help restrain a leg 44 within a cavity 18.

Once the insert is installed in a snap-on manner as described, the interference fit described above is sufficient to restrain the insert from being pulled transversely outwardly of the outer cavities 18 during use. There has thus been described one manner in which one or more elastomeric members may be secured on a bar for the purposes described above. When it is desired to remove an insert 14 from a bar 12, the insert 14 may be slipped longitudinally of the bar 12, so that it slides along the cavity or cavities in which it is disposed and past one of the end faces 24 of the bar.

It is preferred that the transverse cross-section of the bar 12 be substantially uniform along substantially its entire length and most preferably, be constant along its entire length. When such is the case, the bar 12 may advantageously be made in finished form by extrusion, without the necessity of significant post-extrusion machining. Preferably, a bar 12 will be made of an easily extrudable metal such as aluminum.

It is preferred that a typical transverse distance across a hand rail according to the current invention lie within a range between about 0.75 inches and about 2.0 inches, preferably about 1.25 inches.

It is preferred to manufacture and ship the bars 12 in lengths of 4 feet each, or less.

Preferably, an elastomeric member 14, such as an insert, will be made of a composition promoting slip resistance and will be sufficiently rigid so as to resist being pulled transversely from the outer cavities 18 during torque loading. A preferred composition for an elastomeric member is that it may be made from EPDM (Ethylene-Propylene Diene Monomer). It is preferred that an elastomeric member according to the current invention have a Durometer hardness of about 90.

The specific embodiment of a rod 12 according to FIG. 2 has the advantage, in addition to the more general ones discussed above, that the configuration requires a minimum amount of metal because it provides a minimum wall thickness of walls 36.

In the specific embodiment of FIG. 2, longitudinal axis 22 is an axis of symmetry of some elements. For example, the support surfaces 26 form a circle that centers on longitudinal axis 22, as do the exposed surfaces 24. Other elements of the invention form a symmetric pattern about longitudinal axis 22 in the embodiment of FIG. 2. Moreover, as will be described below, longitudinal axis 22 of the embodiment of FIG. 2 may be thought of as an axis of rotation as the grab rail 10 is being installed.

In order that the symmetry that is apparent in FIG. 2 not be misleading, it should be noted especially that longitudinal axis 22 may be any convenient longitudinally-extending reference line passing through the grab rail 10, such as one passing through the centroid of an irregular transverse shape. It is not necessary for the grab rail 10 to be symmetric about longitudinal axis 22 or about any other axis. Moreover, it is not necessary that the elastomeric members 14 be disposed in a regular fashion perimetrically of the grab rail.

Figure 8:
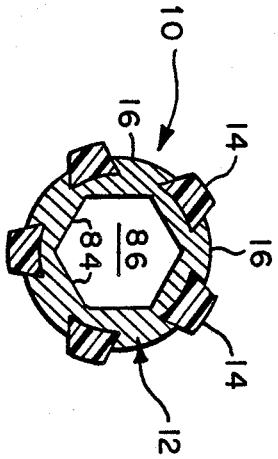
FIGS. 8–10, respectively are transverse cross-sections of three variations of a second embodiment of a grab rail according to the current invention.
Figure 9:
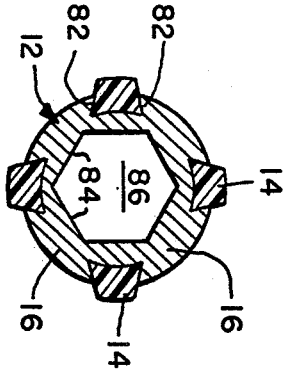
Figure 10:
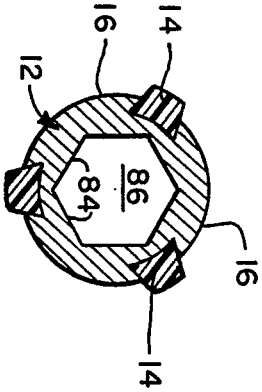

It is apparent that other configurations of the bar 12 and elastomeric member 14 can be used to provide means for securing the elastomeric member on the bar. For example, an inset 52 of an insert 14 may face toward the second leg of the insert. If desired, protrusions analogous to the protrusions 30 may be formed on an insert, with insets analogous to the insets 52 being formed in the bar. As a further example, the embodiment discussed below in regard to FIGS. 8–10 is significantly different, yet still provides interfering securing means for preventing an insert 14 from exiting a cavity 18 in the transverse direction.

Other means capable of securing an elastomeric member on a rod may be used. However, it is preferred that the elastomeric member be an insert disposed in an outer cavity of the rod and designed for reception in the cavity by aligning the insert with the cavity and then pushing the insert transversely into the cavity. It is even more preferred that the insert be secured in the cavity by means that allow for the insert to be separated from the rod by slipping the insert longitudinally of the rod.

It should be noted that variations may occur in the cross-sectional shape of an insert along the length of an insert without altering the ability of the insert to perform its intended function or to be removed from a cavity by slipping the insert longitudinally of the rod. Such variations do not depart from the scope of the invention.

FIG. 4 shows a transverse cross-section, taken on line IV—IV of FIG. 1, of a preferred form of end mount according to the current invention. In particular, there is shown an end stanchion 60 comprising a head 62 supported by a conventional base 64. The base 64 is provided with any conventional means for affixing the stanchion to a wall or the like. Such means may include through holes 66, a central bore 68 and the like.

The mounting hardware such as an end stanchion 60 may be made of a cast metal, preferably a cast zinc alloy such as ZAMAC.

Figure 6:
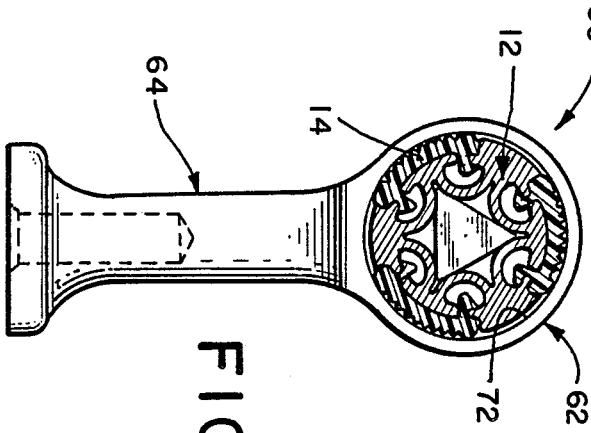

A rail-receiving cavity 70 is formed in head 62 of end stanchion 60. As also shown in FIGS. 5 and 6, rail-receiving cavity 70 is formed by a cylindrical side wall 72 for receiving the generally circular embodiment shown in FIG. 2. The diameter of the rail-receiving cavity 70 approximately equals the maximum diameter of the grab rail 10, which diameter is typically established by the extent, if any, to which the elastomeric members 14 extend outwardly beyond the exposed surfaces of the bar 12. The head 62 comprises a fixed key 74 extending in a longitudinal direction of a grab rail 10. The key 74 may be triangular, as shown in phantom in FIG. 2 and as shown in the longitudinal views of FIGS. 5 and 6. The triangular key 74 is received in the inner cavity 32 of the grab rail 10, according to which the inner cavity 32 may be considered to be a key-receiving opening.

During assembly of the grab rail assembly 1, a grab rail 10 with elastomeric members 14 attached is inserted into rail-receiving cavity 72 the key 74 entering the inner cavity 32 and cooperating with the interior side walls 34 thereof to prevent the grab rail from rotating about longitudinal axis 22 or any other longitudinal axis thereof The other end of the grab rail 10 is then received either in a rail-receiving cavity 72 of a second end stanchion 60, or in a rail-receiving cavity 72 of an inner mount, perhaps in the form of a stanchion, that will be described in more detail below. Preferably, the other end of the grab rail 10 is secured by the combination of key and key-receiving opening like or similar to that set forth above in regard to FIG. 4.

It may be seen that numerous variations are possible. For example, and if desired a key may be formed on a grab rail 10, with a corresponding key-receiving opening being formed in the mounting hardware. Similarly, key shapes other than triangular may be provided, and key-receiving openings having configurations other than as shown in FIG. 2 may be provided.

A particular advantage of the configuration of the inner cavity 32 shown in FIG. 2 is that the number of points 40 is greater than the number of vertices of the triangular key 74. This allows for a number of options during installation of the grab rail assembly, as illustrated in FIGS. 5 and 6. That is, the points 40 of the grab rail 10 are spaced at sixty degrees apart, according to which the grab rail 10 may be fixed in any of a plurality of rotational positions with respect to a longitudinal axis thereof and offering at least two different dispositions of inserts. For example in FIG. 5 an insert 14 is shown disposed at the bottom (with reference to the drawing)

of the grab rail 10, whereas the uppermost surface of grab rail 10 is an exposed surface 24. In contrast FIG. 6 shows an alternative orientation in which an insert 14 is disposed uppermost on the grab rail 10, and an exposed surface 24 of the bar 12 is a lowermost surface of the bar 12.

The versatility provided by the particular mounting arrangement described immediately above is quite beneficial in certain critical locations, such as fire engines and the like, in which directionality is important, as will be understood by those of ordinary skill in the art.

Yet additional variations of key and key-receiving opening are possible. For example when the inserts 14 do not extend all the way to an end face of a bar 12, keys may be fixed about the side wall 72 of the rail receiving cavity 70, such keys being shaped to fit into the outer cavities 18 of the grab rail 10. Any number of such keys may be used, up to and including a number equal to the number of outer cavities 18 in the grab rail 10.

Figure 7:
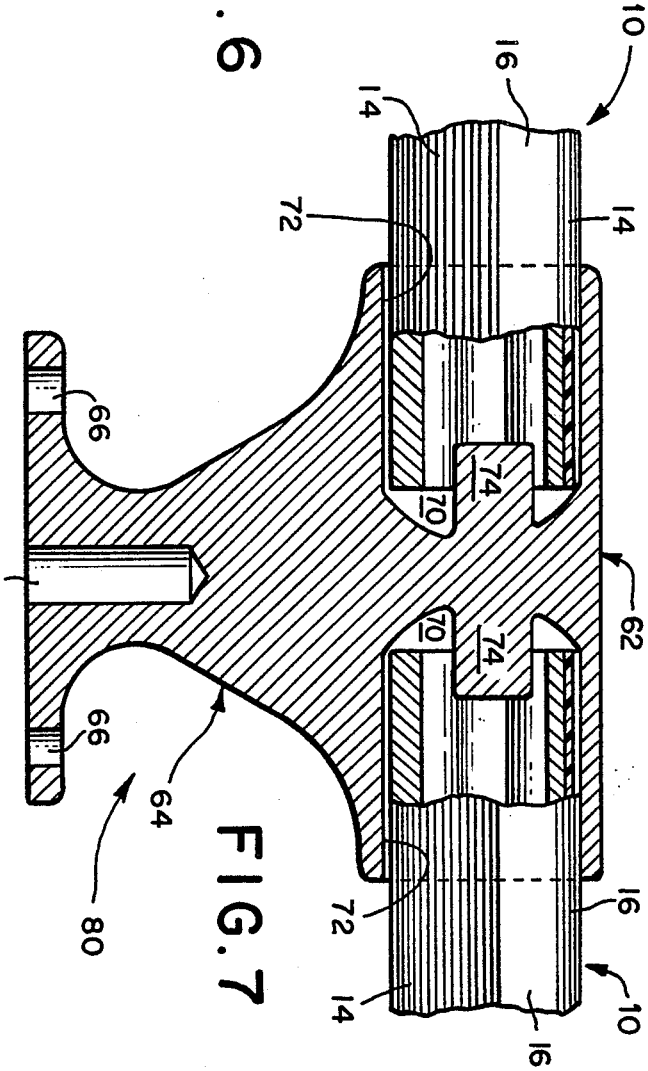
FIG. 7 is a transverse cross-section taken on line VII—VII of FIG. 1 and illustrating an inner mount according to the current invention, the inner mount being shown in a preferred form of a stanchion.

FIG. 7 shows a vertical transverse cross-section of a preferred form of an inner mount in the form of an inner stanchion 80. Inner stanchion 80 comprises two rail-receiving cavities oriented, in this case, coaxially but in opposite directions. Two keys 74 extend in opposite directions. Inner stanchion 80 is otherwise similar to end stanchion 60.

It is believed that the use of inner stanchion 80 will be apparent based upon the explanation of the use of end stanchion 60. In particular, ends of separate grab rails 10 are received in each rail receiving cavity 70, each key 74 being received in a key-receiving opening of the respective rail. Opposite ends of the two rails are received either in additional inner stanchions, in end stanchions, or in other appropriate mounting hardware.

Because the preferred separate grab rails 10 are four feet or less in length they are substantially shorter than traditional eight-foot lengths of grab rail. Accordingly, they are easier to ship, typically incur less damage in shipping, and are easier to handle. Moreover, because a preferred grab rail 10 according to the current invention is shorter, it will be stronger in torsional loading. Even further strength in torsional loading may be obtained by providing, as preferred, that a grab rail 10 is secured at both ends thereof against rotation about a longitudinal axis thereof.

FIGS. 8–10 respectively show transverse cross-sections of three variations of a second embodiment according to the current invention. The three figures differ in the number of inserts 14 provided. Each figure shows a transverse cross-section of a grab rail comprising a rigid elongate bar 12 and a plurality of elastomeric members 14 in the form of inserts disposed proximate exposed surfaces 16 of the bar, the elastomeric members and exposed surfaces 16 collectively forming gripping surfaces disposed so as to be contacted by the hand of a user who has gripped the grab rail.

Side walls 82 (FIG. 9) of longitudinally-extending outer cavities taper toward each other as they extend transversely outwardly so as to form a constricted opening of an outer cavity, such that a distance across the constricted opening is less than a distance across the outer cavity, taken in substantially the same direction and at a location transversely inwardly of the constricted opening.

The tapering side walls 82 of the outer cavities interfere with the slopping walls of the inserts. Accordingly, the inserts are secured against exiting the outer cavities in a transverse direction in response to anticipated torque loadings. Like the first embodiment, the inserts may be removed, if desired, by sliding them longitudinally within the outer cavities, provided that the outer cavities extend the full length of the bar 12, as preferred. However, the configuration of the inserts makes it difficult to assemble the grab rail by snapping the inserts into place as in the first embodiment, so the inserts are introduced into the cavities by slipping them longitudinally of the bar.

The overall dimensions and materials of the grab rails of FIGS. 8–10 are preferably substantially like those of the first embodiment previously described. Key-receiving opening 86 provides a variation over the first embodiment, inasmuch as it forms a polygonal, in this case a hexagonal, cavity formed by flat side walls 84.

As was the case with the first embodiment, during installation the key-receiving opening may cooperate with a suitably-shaped key of the mounting hardware, such as a triangular key, so that the rail may be fixed in any of a plurality of rotational positions, preferably offering at least two different dispositions of elastomeric members. The number of such different dispositions for any particular grab rail may be selected with ease by the choice of the number of inserts 14, the regularity or lack of regularity with which the inserts 14 are disposed perimetrically of the grab rail, the shape (such as the number of sides and vertices) of the key-receiving opening and the shape of the key or keys.

Of course, it should be understood that a wide range of changes and modifications can be made to the preferred embodiments described above. It is therefore intended that the foregoing detailed description be regarded as illustrative rather than limiting and that it be understood that it is the following claims, including all equivalents, which are intended to define the scope of this invention.

We claim:

1. A grab rail mounted to a support surface, said grab rail comprising:

a rigid elongate bar having formed therein at least two outer cavities opening transversely outwardly of said bar;

at least two elastomeric inserts respectively disposed in said outer cavities and extending transversely outwardly at least to a location proximate an exposed surface of said bar, said at least two inserts and at least one exposed surface of said bar collectively forming gripping surfaces disposed so as to be contacted by the hand of a user who has gripped the grab rail; and a mounting stanchion coupled to the bar and secured to the mounting surface;

said bar oriented in said stanchion such that at least one of said inserts is interposed between the bar and the support surface to provide an anti-slip surface when the user grips the bar with at least part of the hand extending between the bar and the support surface.

2. A grab rail according to claim 1, at least one of said inserts extending transversely outwardly to a location beyond an exposed surface of said bar.

3. A grab rail according to claim 1 wherein the bar defines three outer cavities, each receiving a respective one of the inserts, wherein the three outer cavities are disposed symmetrically about the bar, wherein the bar defines a six-way symmetrical central cavity, and wherein the stanchion defines a three-way symmetrical key shaped to fit into the central opening in six separate rotational orientations of the bart with respect to the stanchion.

4. A grab rail according to claim 1 wherein at least two of said inserts are disposed on the bar to face the support surface, at least in part.

5. A grab rail according to claim 1, said bar and at least one of said inserts comprising interfering securing means substantially securing said insert from exiting an outer cavity in a transverse direction.

6. A grab rail according to claim 5, said bar forming a constricted opening of said outer cavity such that a distance across said opening is less than a distance across said outer cavity, taken in substantially the same direction and at a location transversely inwardly of said constricted opening.

7. A grab rail according to claim 5, one of said bar and said at least one insert having an inset formed therein, said inset being defined in part by a restraining surface, the other of said bar and said insert forming a protrusion received in said inset and cooperating with said restraining surface, said interfering securing means comprising said restraining surface and said protrusion.

8. A grab rail according to claim 1, at least one of said inserts being disposed in two of said outer cavities and extending therebetween.

9. A grab rail according to claim 8, said at least one insert extending between said two outer cavities in a perimetric direction of said bar.

10. A grab rail according to claim 8, said bar comprising a support surface between said two outer cavities, said at least one insert comprising a support surface in contact with said support surface of said bar over substantially the entire extent of said support surface of said bar.

11. A grab rail according to claim 8, said at least one insert comprising two legs respectively disposed in said two outer cavities.

12. A grab rail according to claim 11, said bar and at least one of said legs comprising interfering securing means substantially securing said at least one leg against exiting transversely from the outer cavity in which it is disposed.

13. A grab rail according to claim 12 wherein each of said legs is oriented substantially radially with respect to said bar.

14. A grab rail according to claim 1, said outer cavities extending substantially longitudinally of said bar.

15. A grab rail according to claim 14, at least one of said outer cavities opening into at least one end face of said bar.

16. A grab rail according to claim 14, said and at least one of said inserts being configured such that said insert may be separated from said bar by sliding said insert longitudinally of said bar.

17. A grab rail according to claim 16, said bar and at least one of said inserts comprising securing means substantially securing said insert against exiting an outer cavity in a transverse direction.

18. A grab rail according to claim 17, a transverse cross-section of said bar being substantially uniform over substantially the entire length thereof.

19. A grab rail according to claim 16, said outer cavities extending substantially longitudinally of said bar over the entire length of said bar.

20. A grab rail according to claim 19, said inserts extending substantially longitudinally of said bar over the entire length of said bar.

21. A grab rail according to claim 20, a transverse cross-section of said bar being substantially uniform over substantially the entire length thereof.

22. A grab rail assembly comprising a grab rail and mounting hardware therefor, said grab rail comprising a rigid elongate bar having formed therein at least two outer cavities opening transversely outwardly of said bar and at least two elastomeric inserts, each disposed in a respective one of said outer cavities, said inserts extending transversely outwardly at least to a location proximate an exposed surface of said bar, said inserts and at least one exposed surface of said bar collectively forming gripping surfaces disposed so as to be contacted by the hand of a user who has gripped the grab rail, said mounting hardware comprising at least one mount for receiving an end of said grab rail and for fixing said grab rail at a desired location, said grab rail and said at least one mount comprising at least one key for reception in at least on key-receiving opening for preventing said grab rail from rotating about a longitudinal axis thereof;

said mount defining a mounting surface adapted to bear against a support surface;

said bar oriented in said mount such that at least one of the inserts is interposed between the bar and the mounting surface to provide an anti-slip surface when the user grips the bar with at least part of the hand extending between the bar and the support surface.

23. A grab rail assembly according to claim 22, comprising a second grab rail and mounting hardware interposed between the first and second grab rails, said mounting hardware comprising means for affixing said first and second grab rails at desired locations, said mounting hardware and said first and second grab rails comprising at least two keys for reception in at least two key-receiving openings for preventing said first and second rails from rotating about longitudinal axes thereof.

24. A grab rail assembly according to claim 22 wherein the bar defines three outer cavities, each receiving a respective one of the inserts, wherein the three outer cavities are disposed symmetrically about the bar, wherein the key-receiving opening is defined by a six-way symmetrical central opening in the bar, and wherein the key comprises a three-way symmetrical protrusion defined by the mount and shaped to fit into the central opening in six separate rotational position so the bar with respect to the mount.

25. A grab rail assembly according to claim 22, said mounting hardware and said grab rail comprising means for fixing said rail in a plurality of rotational positions with respect to a longitudinal axis thereof.

26. A grab rail assembly according to claim 25, said rod having formed therein at least two said cavities, said grab rail comprising at least two of said inserts respectively disposed in said cavities, said mounting hardware and said grab rail comprising means for fixing said rail in a plurality of rotational positions offering at least two different dispositions of said inserts.

27. A grab rail assembly according to claim 22, said grab rail having formed therein at least one key-receiving opening extending longitudinally of said bar from an end face of said bar.

28. A grab rail assembly according to claim 27, said key-receiving opening extending internally of said bar.

29. A grab rail assembly according to claim 28, said key-receiving opening extending entirely through said bar from said end face to an opposite end face thereof.

* * * * *